United States Patent [19]

Nelsen

[11] Patent Number: 4,960,307

[45] Date of Patent: Oct. 2, 1990

[54] VERTICAL STORAGE UNIT FOR MODULAR FURNITURE

[75] Inventor: Randall P. Nelsen, Alto, Mich.

[73] Assignee: Steelcase, Inc., Grand Rapids, Mich.

[21] Appl. No.: 307,682

[22] Filed: Feb. 7, 1989

[51] Int. Cl.[5] ..... A47B 17/00

[52] U.S. Cl. ..... 312/194; 312/330.1; 312/320

[58] Field of Search ..... 312/320, 330 R, 128–132, 312/194, 330.1

[56] References Cited

U.S. PATENT DOCUMENTS

| | | | |
|---|---|---|---|
| 587,741 | 8/1897 | King | 312/132 |
| 637,361 | 11/1899 | Suters | 312/131 |
| 2,418,919 | 4/1947 | Benson | 312/330 R |
| 2,425,232 | 8/1947 | Earle | 312/330 X |
| 2,826,475 | 3/1958 | Larson | 312/330 R |
| 3,365,259 | 1/1968 | Heisman et al. | 312/194 |
| 3,596,297 | 8/1971 | James . | |
| 4,026,616 | 5/1977 | Kuehl | 312/250 |
| 4,412,772 | 11/1983 | Naito et al. | 414/331 |
| 4,755,009 | 7/1988 | Price et al. | 312/194 |
| 4,784,446 | 11/1988 | Newhouse | 312/317 |

*Primary Examiner*—Joseph Falk

*Attorney, Agent, or Firm*—Price, Heneveld, Cooper, DeWitt & Litton

[57] ABSTRACT

A vertical storage unit is provided for modular furniture of the type having a worksurface with an open knee space below the worksurface. The storage unit includes an open framework drawer, which is slidably mounted in a hollow cabinet for horizontal movement between a closed position in which the sides of the drawer are disposed in the cabinet, and an open position in which the sides of the drawer are disposed outside of the cabinet, and extend perpendicular beyond the worksurface. A plurality of removable, drop-in storage trays are suspended from the drawer framework in a vertically spaced apart relationship. The sides of the drawer are open to access each storage tray, such that when the drawer is in the open position, objects may be placed into and removed from the vertically arranged storage trays with a generally vertical hand motion. Convenient storage is thereby provided within arm's length of the worksurface, without encroaching upon the knee space below the worksurface, so as to provide improved freedom of movement, particularly in task environments.

17 Claims, 6 Drawing Sheets

VERTICAL STORAGE UNIT FOR MODULAR FURNITURE

CROSS-REFERENCE TO RELATED APPLICATIONS

The present application is related to co-pending U.S. Pat. application Ser. No. 307,775, filed Feb. 7, 1989, entitled MODULAR FURNITURE, which is hereby incorporated by reference.

BACKGROUND OF THE INVENTION

The present invention relates to furnishings for offices and other similar settings, and in particular to a vertical storage unit for modular office furniture, and the like.

Open office plans are well known in the art, and generally comprise large, open floor spaces that are partitioned off into individual workstations by movable panels. Partition panels in such open office plans are typically configured to receive hang-on furniture units, such as worksurfaces, overhead cabinets, shelves, etc., so that the panels become an integral part of the workstation furnishings. Center drawer units are often mounted underneath the worksurfaces at selected locations to provide convenient, closed storage areas at the workstations for certain types of frequently used articles, such as pencils, paper clips, note pads, and the like. One example of such a partition panel arrangement is disclosed in the Breiner Patent No. 3,916,972.

The above-noted partition panels and hang-on furniture arrangements are usually known in the office furniture industry as "systems furniture." Such systems furniture arrangements have some inherent restrictions in versatility, since each workstation must necessarily include certain types of partition panels in order to support the hang-on furniture units Furthermore, the hang-on furniture units can generally be assembled only in a rather limited number of different arrangements.

A unique alternative arrangement for dividing and partitioning open office plans is disclosed in related co-pending application Ser. No. 307,775, filed Feb. 7, 1989, entitled MODULAR FURNITURE, which has been incorporated by reference into the present application. This new arrangement provides a plurality of individual furniture units, each of which is independently supported on the floor of the open office. The freestanding furniture units have a novel modular construction which permits them to be individually arranged and combined in a predetermined configuration to create distinct workstations.

Another problem associated with conventional systems furniture relates to center drawer storage in task workstations. Many modern workstations are designed with separate task areas along a common worksurface, such as for correspondence, drafting, communications, computer operations, and the like. A castered task chair is normally provided at such workstations to permit the worker to easily move between the task areas of the workstation, while remaining seated in the chair. While conventional center drawers provide very convenient storage for frequently used articles, they protrude into the knee space underneath the worksurface, and thereby tend to interfere with the movement of the seated user as he moves in his chair between task areas along the worksurface. Furthermore, center drawer arrangements normally have limited storage space that is readily usable, since the worker must physically move out of the way to access the rear portions of the center drawer.

SUMMARY OF THE INVENTION

One aspect of the present invention is to provide a vertical storage unit or pedestal for modular furniture. The storage unit includes a drawer, which is slidably mounted in a hollow cabinet for horizontal movement between a closed position wherein the sides of the drawer are disposed generally in the cabinet, and an open position wherein the sides of the drawer are disposed generally outside the cabinet, and extend perpendicularly beyond the worksurface of the associated modular furniture unit. A plurality of storage elements are mounted in the drawer in a vertically spaced apart relationship. At least one of the sides of the drawers is open to access each storage element, such that when the drawer is in the open position, objects may be placed into and removed from the vertically arranged storage elements with a generally vertically hand motion. Convenient storage is thereby provided within arm's length of the worksurface, without encroaching upon the knee space beneath the worksurface.

Preferably, the drawer includes an open framework on which a plurality of differently shaped removable trays are suspended in a drop-in fashion, so that the interior arrangement of the storage unit can be readily changed to accommodate a wide variety of different users and applications. Also, a series of different style drawer pulls may be removably attached to the drawer, so as to personalize the exterior appearance of the storage unit.

The principal objects of the present invention are to provide convenient storage for frequently used office articles, without encroaching upon the knee space below the worksurface. The vertical storage unit may be used in lieu of a center drawer, and provides improved freedom of movement along the worksurface, particularly in task environments. The storage unit has increased storage capacity, while permitting full access to the vertically arranged storage trays without requiring the user to move from his seated position. An open drawer framework with removable, drop-in suspended trays permits the user to readily adapt the storage unit for his or her particular needs. Differently styled, removable pulls may also be attached to the drawer to personalize or customize the exterior appearance of the unit. The storage unit is efficient in use, economical to manufacture, capable of a long operating life, and particularly well adapted for the proposed use.

These and other advantages of the invention will be further understood and appreciated by those skilled in the art by reference to the following written specification, claims and appended drawings.

DETAILED DESCRIPTION OF THE PREFERRED EMBODIMENTS

Figure 3:
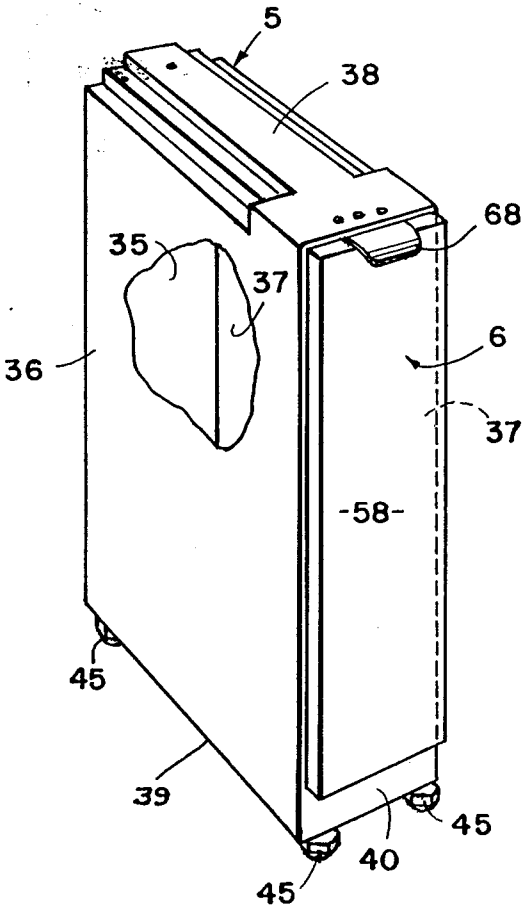
FIG. 3 is a perspective view of the vertical storage unit, with portion thereof broken away to reveal internal construction.

For purposes of description herein, the terms "upper," "lower," "right," "left," "rear," "front," "vertical," "horizontal," and derivatives thereof shall relate to the invention as oriented in FIG. 3. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein, are not to be considered as limiting, unless the claims expressly state otherwise.

Figure 13:
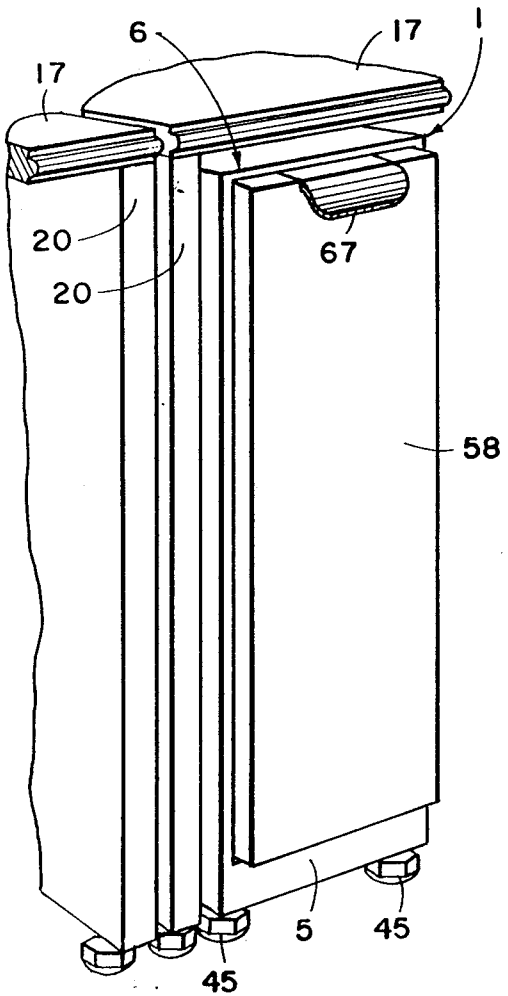
FIG. 13 is a perspective view of the vertical storage unit and furniture unit, with the drawer shown in a full closed position.

The reference numeral 1 (FIG. 1) generally designates a vertical storage unit or pedestal embodying the present invention. Storage unit 1 is particularly adapted for use in conjunction with office furniture, such as the illustrated modular furniture units 2, which have a worksurface 3 with an open knee space 4 below the worksurface 3. Storage unit 1 includes a cabinet 5 (FIG. 4) in which a drawer 6 (FIG. 5) is slidably mounted for horizontal movement between a closed position (FIG. 13) wherein the sides of drawer 6 are disposed inside cabinet 5, and an open position (FIG. 14) wherein the sides of drawer 6 are disposed outside of cabinet 5, and extend perpendicularly beyond worksurface 3. A plurality of storage elements 7 are mounted in drawer 6 in a vertically stacked o spaced apart relationship. At least one side of drawer 6 is open to access each storage element 7, such that when drawer 6 is in the open position (FIG. 14), objects may be placed into and removed from the vertically arranged storage elements 7 with a generally vertical hand motion. Convenient storage is thereby provided adjacent worksurface 3, without encroaching upon the knee space 4 below worksurface 3.

Figure 1:
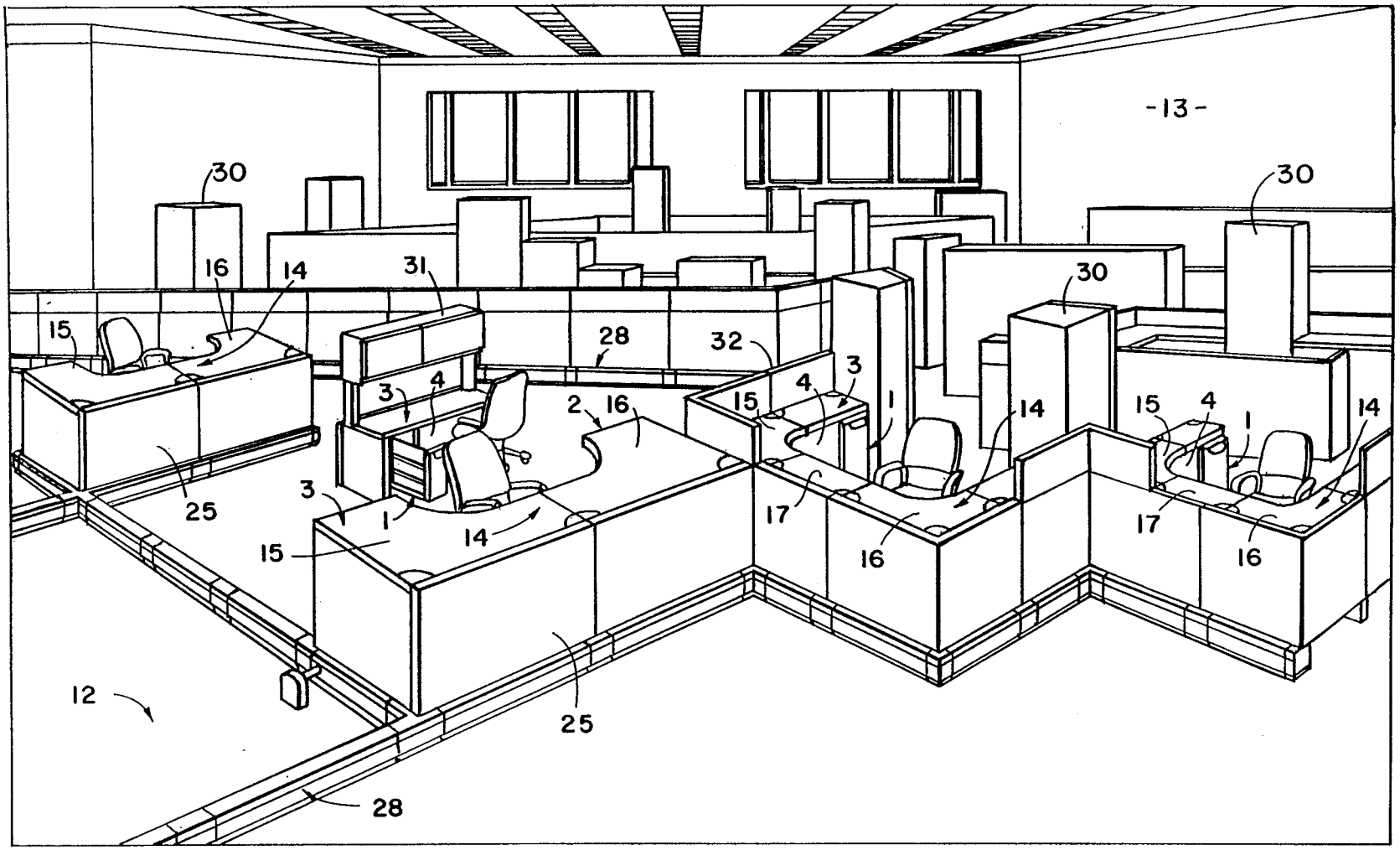
FIG. 1 is a perspective view of a plurality of modular furniture units arranged in a predetermined configuration, including vertical storage units embodying the present invention.
Figure 2:
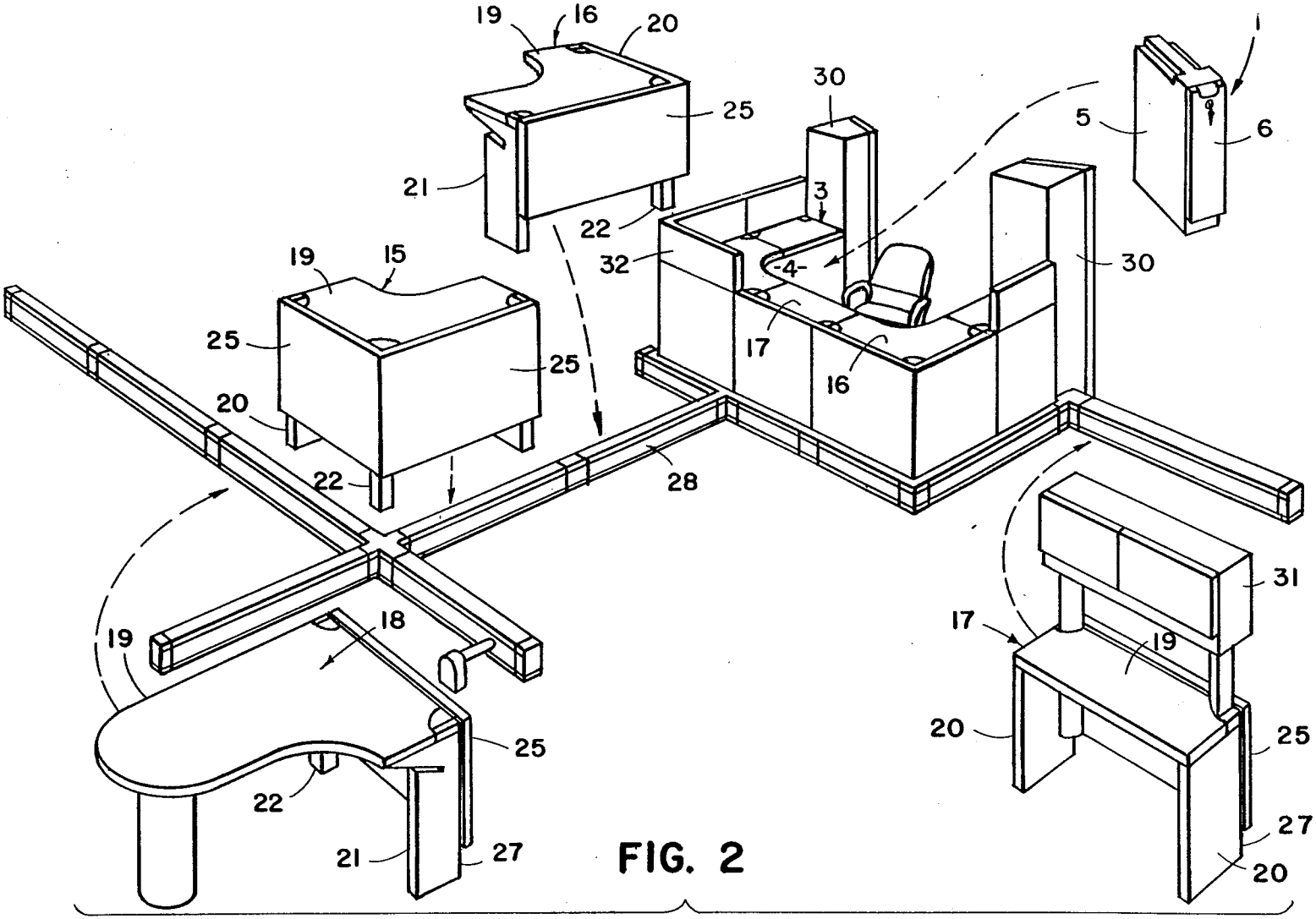
FIG. 2 is an exploded perspective view of selected modular furniture units, and one of the vertical storage units.

As will be appreciated by those skilled in the art, storage unit 1 can be used in conjunction with a wide variety of different office furniture arrangements. With reference to FIGS. 1 and 2, storage unit 1 is particularly adapted for use in conjunction with a unique modular furniture arrangement which is the subject of co-pending patent application Ser. No. 307,775, filed Feb. 7, 1989 entitled MODULAR FURNITURE. The illustrated modular furniture arrangement comprises a plurality of individual furniture units 2, each of which is independently supported on the floor 12 of office space 13, and is shaped to cooperate with other related furniture units 2 to form workstations 14.

In the examples illustrated in FIGS. 1 and 2, several different types of modular furniture units 2 are illustrated, which are individually designated by the reference numerals 15–18 respectively. Each of the illustrated furniture units 15–18 (FIG. 2) includes a worksurfaces selected from a Wide Variety of different shapes and sizes, and two separate supports at the opposite ends of worksurface 19, in the form of either an end panel 20, or an intermediate support 21. For example, the left-hand corner unit 16 has an intermediate support 21 at one end of worksurface 19, and an end panel 20 at the opposite end of worksurface 19. In contrast, the straight unit 17 has two end panels 20 at the opposite ends of worksurface 19. A corner leg 22 is provided at the center of the right-hand corner unit 15, the left-hand corner unit 16, and the bullet conference unit 18.

Each of the illustrated modular furniture units 15–18 also includes at least one back panel 25, which covers the front faces or surfaces of the furniture unit. For example, the straight unit 17 (FIG. 2) has a single back panel 25 which extends between the two end panels 20 along the forward side of the furniture units. Both the right-hand and left-hand corner units 15 and 16 have two back panels 25, which extend between the corner leg 22 and the associated end support. Back panels 25 have a specially designed, predetermined depth, so as to form a gap or recess 27, which extends along the forward base area of each of the furniture units 7, and is adapted to receive therein a unique floor track system 28 for utilities, which is the subject of a co-pending patent application. The arrangement illustrated in FIG. 2 clearly shows the recess 27 in each of the furniture units 15–18, and its physical cooperation with the floor track system 28.

In the open office plan arrangements illustrated in FIGS. 1 and 2, additional modular furniture units 7 and related accessories are provided, including storage towers 30, overhead cabinets 31, and privacy screens 32 which are attached to and extend upwardly from the forward edges of selected furniture units to provide a degree of privacy to the workstations 14. Many characteristics of these additional furniture units and accessories are unique, independent of storage unit 1, and are the subject of co-pending patent applications.

With reference to FIGS. 1 and 2, the illustrated storage unit 1 is in the nature of a dayfiler, and is designed to fit beneath the worksurface 3 of any one of modular furniture units 15–18 to provide closed storage for the associated workstation 14.

Figure 4:
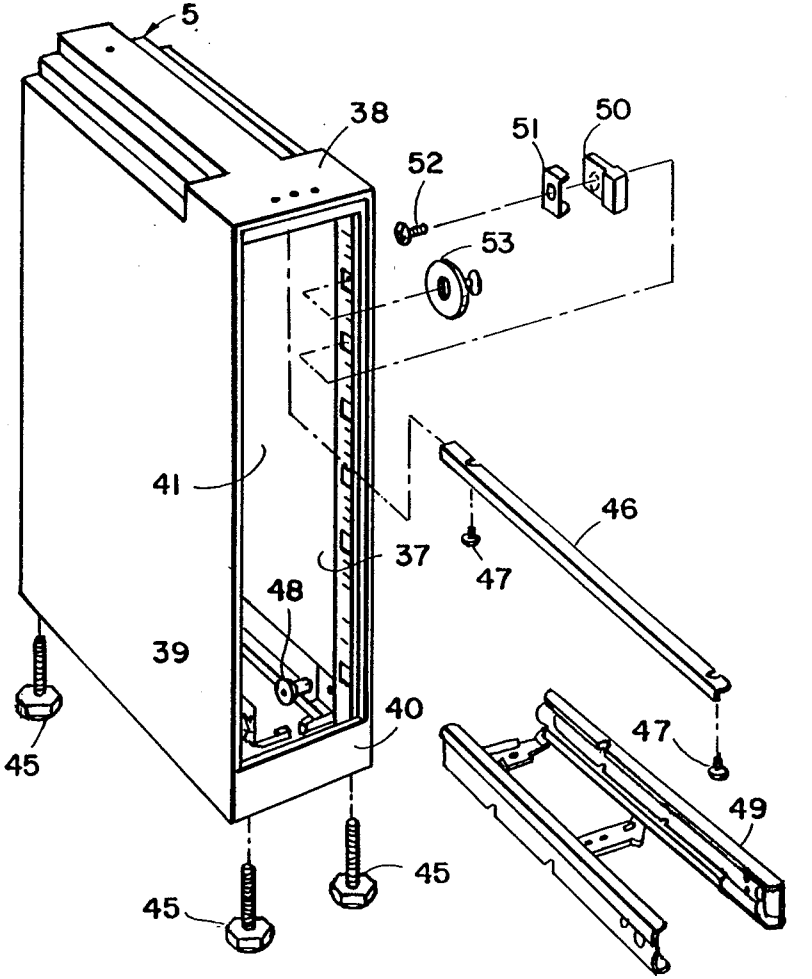
FIG. 4 is an exploded perspective view of a cabinet portion of the vertical storage unit.

As best illustrated in FIGS. 3 and 4, cabinet 5 has a generally rectangularly shaped body, including a rear wall 35, opposite sidewalls 36 and 37, a top 38, and bottom 39. The front of cabinet 5 is defined by a frame 40, having an elongated vertically extending opening 41 in which drawer 6 is received in the manner described in greater detail hereinafter.

Cabinet 5 is a freestanding unit that is abuttingly supported directly on the floor 12 of office space 13, and in the illustrated example, includes vertically adjustable feet or glides 45 mounted at each lower corner of cabinet 5. A center track glide 46 is attached to the interior surface of top panel 38 by fasteners 47, and extends in a fore-to TM aft direction along the center portion of top panel 38. Track glide 46 serves to align drawer 6 in cabinet 5 in the manner described below. Rollers 48 are pivotally mounted on the sidewalls 36 and 37 of cabinet 5 adjacent bottom panel 39, and slidably support a drawer cradle or suspension assembly 49. A drawer bumper 50 is attached to the forward upper portion of cabinet 5 by a retainer 51 and fastener 52. Bumper 50 serves to cushion the impact between drawer 6 and cabinet 5 when drawer 6 is closed. An anti-rebound button 53 is mounted on cabinet 5 directly above bumper 50, and also serves to dampen the impact between drawer 6 and cabinet 5 when drawer 6 is closed.

Figures 5, 6, 7, 8, 9:
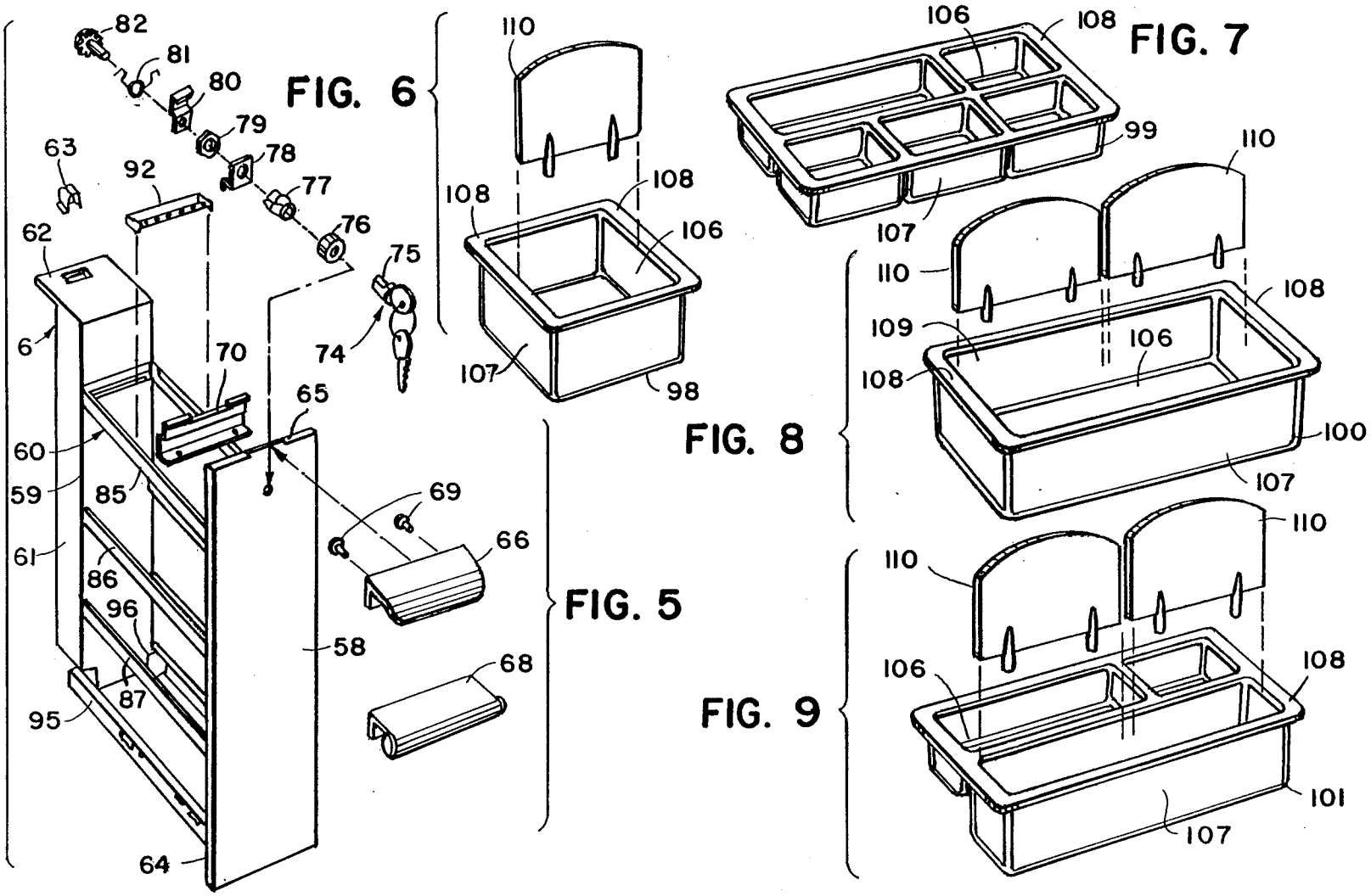
FIG. 5 exploded perspective view of a drawer portion of the storage unit.
FIG. 6 is a perspective view of a storage tray portion of the storage unit.
FIG. 7 is a perspective view of an alternative storage tray design.
FIG. 8 is a perspective view of another alternative storage tray design.
FIG. 9 is a perspective view of another alternative storage tray design.

With reference to FIG. 5, drawer 6 includes a front panel 58 and a rear panel 59, which are interconnected by an open framework 60. Rear panel 59 has an inverted L-shaped side elevational configuration, which includes side panels 61, and a top panel 62 with a slide block 63 protruding upwardly therefrom. Slide block 63 is closely received within track glide 46, and serves to center the upper portion of drawer 6 in cabinet 5, particularly when drawer 6 is closed and opened.

Drawer front panel 58 covers the cabinet opening defined by frame 40 in a slab door fashion, and has a substantially rectangular front elevational configuration similar to that of frame opening 41. Front panel 58 includes a marginal edge 64, with a notch 65 positioned in the center of the top section of marginal edge 64. Notch 65 is shaped to receive one of a plurality of differently shaped drawer pulls 66 and 68 therein. The drawer pulls 66 and 68 are attached to front panel 58 by a pair of fasteners 69, which extend through the rear surface of front panel 58. An inner panel 70 is mounted on the interior surface of front panel 58 at the upper portion thereof, and reinforces the same at the area in which pulls 66 and 68 are attached.

A lock assembly 74 may be mounted in the front panel 58 of drawer 6 to selectively lock drawer 6 in cabinet 5. In the illustrated example, lock assembly 74 includes a plug assembly 75, a lock adapter 76, a lock barrel 77, a bracket 78, a nut 79, a strike plate 80, a lock spring 81, and a mounting screw 82.

Drawer 6 also includes a pair of suspension rails 95 and 96 (FIG. 5), which are attached to and extend between front panel 58 and rear panel 59 at the lowermost corners thereof. Suspension rails 95 and 96 are connected with suspension assembly 49, and serve to slidingly support drawer 6 in cabinet 5 in a suspended or cantilevered manner.

In the illustrated example, drawer framework 60 comprises three individual frames 85-87 (FIG. 5), which are arranged in a mutually parallel, vertically spaced apart relationship. Each frame 85-87 has a substantially rectangular top plan configuration, and includes end rails 88 and 89 (FIGS. 11 and 12), and opposite side rails 90 and 91. Each of the frame rails 88-91 has a generally L-shaped transverse cross-sectional shape, with the lower flange oriented inwardly toward the center of the associated frame 85-87, so as to form a pocket or socket in which the various storage elements 7 are received and supported in a hanging or suspended fashion. In addition to securely supporting storage elements 7, frames 85-87 securely interconnect the front and rear panels 58 and 59 to produce a very rigid, yet open construction for drawer 6. The uppermost frame 85 (FIG. 11) is spaced downwardly from the top edges of front and rear panels 58 and 59 respectively, so as to provide sufficient vertical clearance to access all storage elements 7 that might be supported therein. The lowermost frame 87 is positioned upwardly from the lower edges of front and rear panels 58 and 59, so as to provide bottom clearance space for all storage elements 7 that might be supported therein. A plurality of hanger channels 92 (FIGS. 5 and 10) are provided, which have a length substantially equal to the width of frames 85-87, so as to span between the adjacent side rails 90 and 91, and provide intermediate support for certain types of storage elements 7, as described in greater detail hereinafter.

Storage elements 7 may include any type of container which is shaped to retain articles therein, and is adapted to be supported on drawer framework 60. In the illustrated example, storage elements 7 include differently shaped removable trays 98-101, as well as hanging files 102. It is to be understood that other types of storage elements 7 may also be used in drawer 7.

Figure 11:
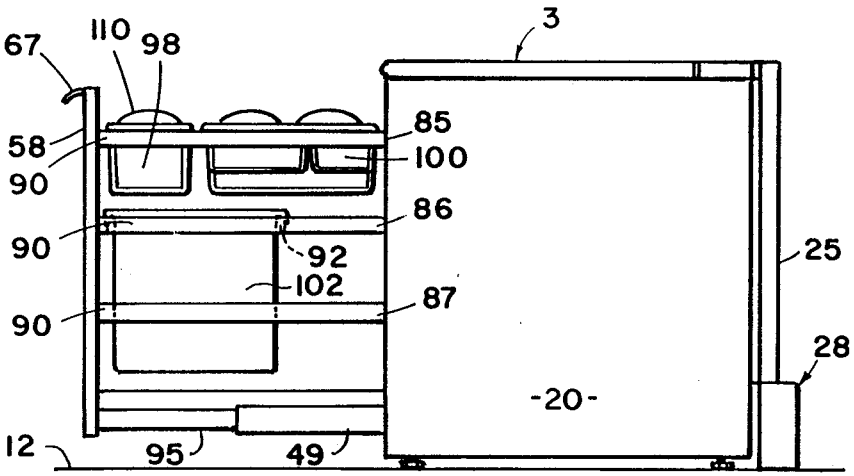
FIG. 11 is a side elevational view of the vertical storage unit and modular furniture unit of FIG. 10, with the drawer shown in a open position.
Figure 14:
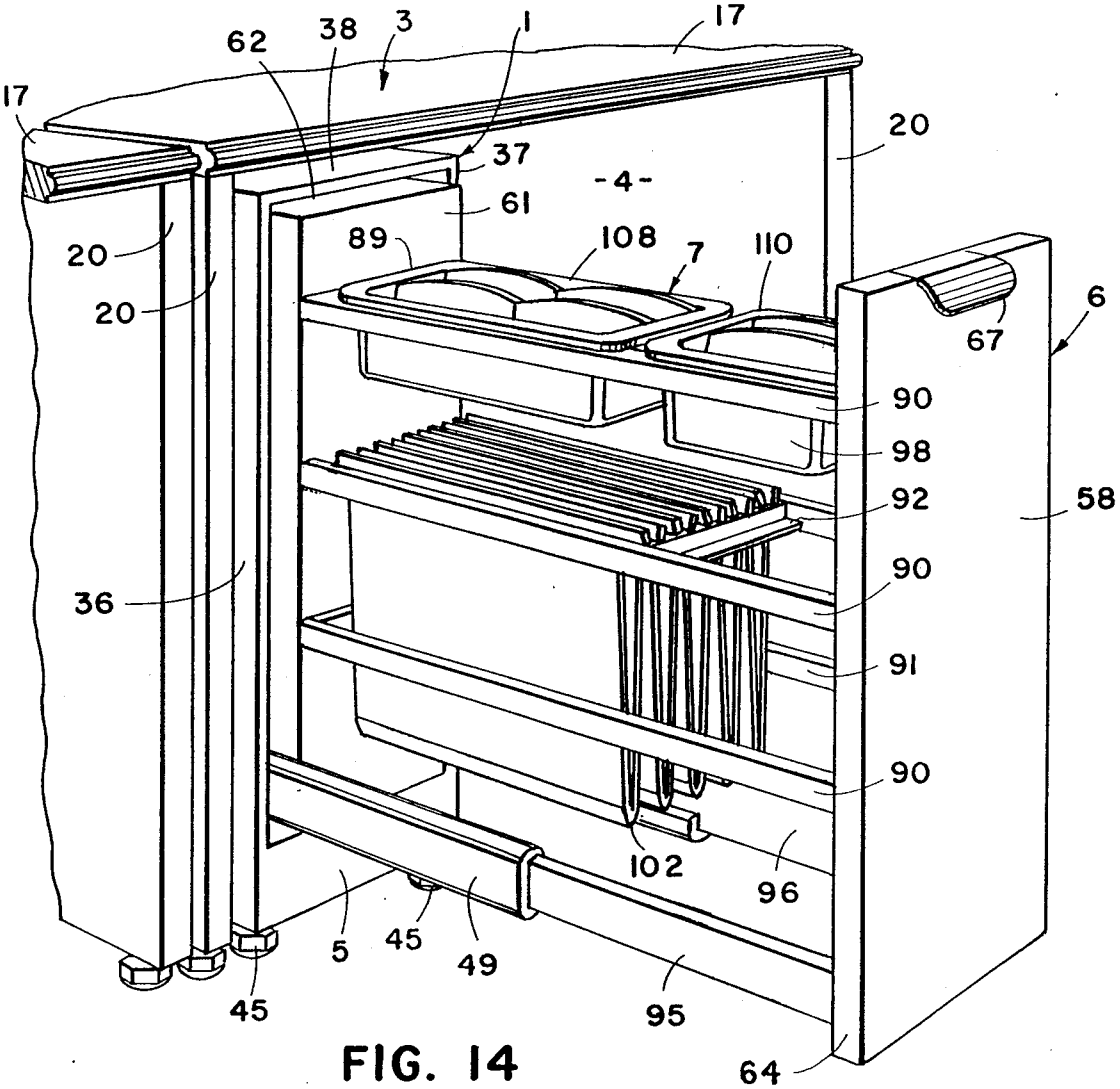
FIG. 14 is a front perspective view of the vertical storage unit and modular furniture unit, with the drawer shown in the fully open position.

As best illustrated in FIGS. 11 and 14, each frame 85-87 is adapted to support hanging files 102 therefrom between end rails 88 and 89. The position and depth of hanging files 102 is preferably selected so as not to interfere with the vertically adjacent storage elements 7. Hanging files 102 may be supported either directly on the end rails 88 and 89, and/or hanger channels 92, such that hanging files 102 open with a lateral motion.

With reference to FIGS. 6-9, each of the illustrated trays 98-101 comprises a rigid, integrally molded container, having a base 106, upstanding sidewalls 107, and an upper peripheral edge or lip 108 which extends laterally outwardly of sidewalls 107. The base 106 and sidewalls 107 of trays 98-101 are configured differently for various uses, but generally comprise at least one compartment 109 in which articles ar received and retained. Dividers 110 are also provided to partition selected compartments 109 into more than one area. The upper lip 108 each tray 98-101 is rigid and has a generally rectangular plan configuration that is designed to be abuttingly supported on an associated one of the frames 85-86 of drawer framework 60. Trays 98-101 simply drop into the sockets formed by frames 85-87, and are supported thereon by the associated tray lip 108 in a hanging or suspended manner. The base 106 and sidewall 107 of trays 98-101 depend from the associated frame 85-87 through the socket or opening formed therein. Trays 98-101 are thereby abuttingly supported along at least two opposite sides or ends of the tray for very secure support, even for relatively heavy articles.

The illustrated tray 98 (FIG. 6) comprises a media tray, and is specifically designed to receive and retain computer diskettes therein in an on-edge, angular orientation. The illustrated tray 99 (FIG. 7) comprises a pencil tray, and includes five separate compartments 109, one of which is longer than the others to receive elongated articles therein. The illustrated tray 100 (FIG. 8) comprises an envelope/media tray, and is a shape to receive both computer diskettes and stationery envelopes therein. The illustrated tray 101 (FIG. 9) comprises a pencil/envelope tray, and is adapted to receive both computer diskettes and writing instruments therein. In the illustrated examples of FIGS. 5–9, dividers 110 are inserted into trays 98, 100 and 101 to further divide at least one of the compartments.

Figure 10:
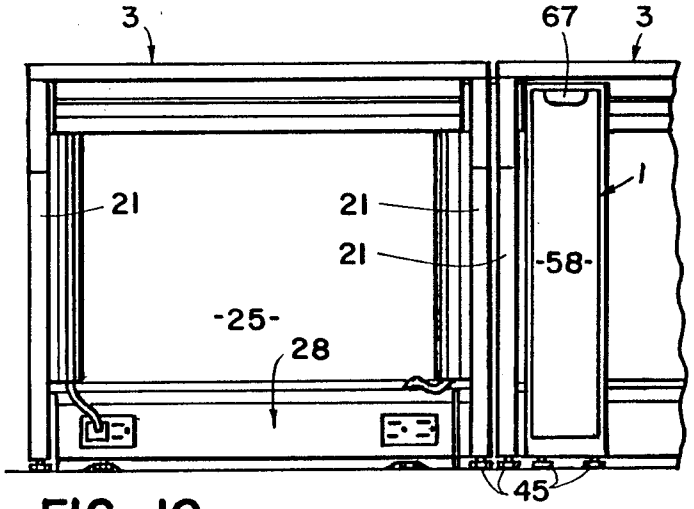
FIG. 10 is a front elevational view of the vertical storage unit, shown positioned underneath a modular furniture unit.
Figure 12:
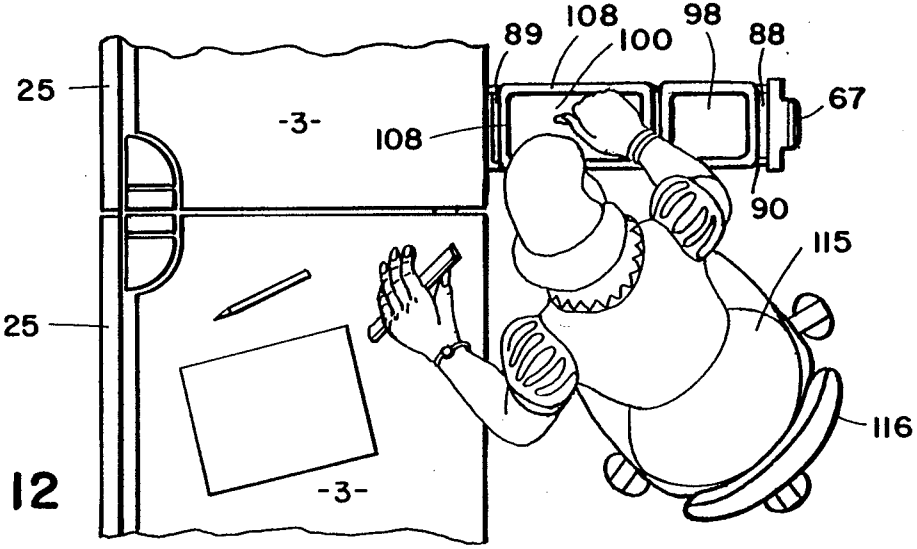
FIG. 12 is a plan view of the vertical storage unit, and modular furniture unit of FIG. 10, with the drawer shown in the position.

With reference to FIGS. 10–12, storage unit 1 is adapted to be positioned beneath the worksurface 3 of an associated modular furniture unit 2, such as the illustrated straight units 17. Since the adjacent straight units 17 have cantilevered intermediate supports 21, the knee space 4 beneath the adjacent worksurfaces 3 is substantially open. It is to be understood that storage unit 1 may be positioned at any convenient location in the workstation 14, including between adjacent file drawer pedestals or the like. In the illustrated arrangement, storage unit 1 is positioned immediately adjacent to the intermediate support 21 of the right-hand straight unit 17. Storage unit 1 is supported freestanding on floor 12 of office space 13 by glides 45, which are adjusted so that storage unit 1 is square with respect to straight unit 17. Since storage unit 1 is not attached to the modular furniture units 2, it can be easily positioned at a variety of different locations beneath worksurface 3. As best illustrated in FIG. 12, with a worker 115 sitting in a task chair 116 near the center of left-hand straight unit 17, the worker can easily open and close drawer 6, without moving out of the way. The open framework 60 of drawer 7 renders all storage elements 7, including trays 98–101 and hanging files 102, fully accessible from either side of drawer 6. The seated user 115 can readily translate his or her chair 116 between the adjacent furniture units 17. Storage unit 1 thereby provides convenient storage within arm's length of worksurface 3 without encroaching upon knee space 4, so as to provide improved freedom of movement, particularly in task environments.

The vertically stacked arrangement of storage elements 7 provides substantial closed storage area in a compact manner. Storage unit 1 permits an uncluttered worksurface 3 in a task environment, without those drawbacks associated with prior center drawer arrangements.

Preferably, each individual worker selects those particular storage elements 7 which are best suited for his needs, and inserts or drops the same into the frames 85–87 of drawer framework 60. When the selected hanging files 102 do not span the entire length of the associated frames 85–87, hanger channels 92 are inserted between the opposite frame side rails 90 and 91. In this manner, each worker is able to personalize or customize the interior arrangement of the storage unit 1 associated with his or her particular workstation. Furthermore, the worker can further personalize the exterior appearance of his or her storage unit 1 by selecting one of the various pull designs 66 and 68, and attaching the desired pull to the front panel 58 of drawer 6 by fasteners 69. Hence, both the interior and exterior of storage unit 1 can be easily personalized by the worker himself, without the need for skilled maintenance personnel.

Storage unit 1 can be used in lieu of a center drawer in task furniture arrangements, so as to provide convenient storage for frequently used articles, without encroaching upon the knee space 4 below the worksurface 3. The vertical storage unit 1 provides increased storage area, which may be fully accessed from either side of the drawer 6 when the drawer 6 is in the open position. The open framework 60 and removable storage element 7 permit the worker to select his own particular storage layout. The removable pulls 66–68 also permits the user to customize or personalize the exterior appearance of storage unit 1.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows.

1. In combination, modular furniture, of the type which includes at least one worksurface with a front edge and an open knee space therebelow, and a vertical storage unit therefor, comprising:

a hollow, vertically extending cabinet shaped to be supported in a generally vertical orientation underneath the worksurface at a location laterally adjacent to one side of the knee space;

a drawer having a front panel, a rear panel, and a rigid, open framework interconnecting, said front and rear panels, said framework having opposite sides, and including at least two open frames disposed in a vertically stacked relationship, with each of said open frames having a generally closed perimeter;

means for slidably mounting said drawer in said cabinet for generally horizontal movement in a direction substantially perpendicular to the front edge of the worksurface between a closed position wherein a major portion of said open framework is disposed inside of said cabinet body, and an open position wherein a major portion of said open framework is disposed outside of said cabinet body, and protrudes outwardly therefrom beyond the worksurface;

a plurality of individual storage elements adapted to retain objects therein, and shaped to drop into one of said open frames and be removeably supported from the closed perimeter thereof in a hanging fashion; said storage elements being removably mounted in said open framework in a vertically spaced apart relationship; both sides of said open framework being open to laterally access each of said storage elements from either side of said drawer; said storage elements each being shaped to receiver and remove objects therefrom with a generally vertical motion when said drawer is in the open position, whereby convenient storage is provided within arm's length of the worksurface without encroaching upon the knee space to provide improved freedom of movement, particularly in task environments.

2. A vertical storage unit as set forth in claim 1, wherein:

said storage elements are each oriented generally horizontally.

3. A vertical storage unit as set forth in claim 2, wherein:

said cabinet defines the one side of the knee space.

4. A vertical storage unit as set forth in claim 3, wherein:

said storage elements have a modular shape adapted to be received and supported in plurality of different positions in said framework to adapt the interior arrangement of said storage unit for a wide variety of users and applications.

5. A vertical storage unit as set forth in claim 4, including:

a plurality of differently styled pulls shaped to facilitate opening and closing said drawer; and means for detachably connecting one of said differently styled pulls to said drawer to personalize the exterior appearance of said vertical storage unit.

6. A vertical storage unit as set forth in claim 5, wherein:

said framework is shaped to receive and support hanging files thereon.

7. A vertical storage unit as set forth in claim 6, wherein:

said storage elements include a plurality of differently shaped and sized trays adapted to retain various articles therein.

8. A vertical storage unit as set forth in claim 7, wherein:

said trays include a media tray with inserts shaped to receive and retain therein diskettes in an on-edge, angular orientation.

9. A vertical storage unit as set forth in claim 8, wherein:

said trays include a pencil tray shaped to receive and retain elongate objects therein.

10. A vertical storage unit as set forth in claim 9, wherein:

said cabinet is freestanding on a floor surface to facilitate placement of said vertical storage unit underneath the worksurface at a variety of different locations.

11. A vertical storage unit as set forth in claim 1, wherein:

said cabinet defines the one side of the knee space.

12. A vertical storage unit as set forth in claim 1, including:

a plurality of differently styled pulls shaped to facilitate opening and closing said drawer; and means for detachably connecting one of said differently styled pulls to said drawer to personalize the exterior appearance of said vertical storage unit.

13. A vertical storage unit as set forth in claim 1, wherein:

said drawer is shaped to receive and support hanging files thereon.

14. A vertical storage unit as set forth in claim 1, wherein:

said storage elements include a plurality of differently shaped and sized trays adapted to retain various articles therein.

15. A vertical storage unit as set forth in claim 1, wherein:

said cabinet is freestanding on a floor surface to facilitate placement of said vertical storage unit underneath the worksurface at a variety of different locations.

16. A vertical storage unit for modular furniture, and the like of the type which includes at least one worksurface with a front edge and an open knee space therebelow said storage unit comprising:

a hollow, vertically extending cabinet shaped to be supported in a generally vertical orientation underneath the worksurface at a location laterally adjacent to one side of the knee space;

a drawer having a front panel, a rear panel, and a rigid open framework interconnective said front and rear panels; said framework having opposite sides, and including at least two open frames disposed in a vertically stacked relationship with each of paid open frames having a generally closed perimeter;

means for slidably mounting said drawer in said cabinet for generally horizontal movement in a direction substantially perpendicular to the front edge of the worksurface between a closed position wherein a major portion of said open framework is disposed inside of said cabinet body, and an open position wherein a major portion of said open framework is disposed outside of said cabinet body, and protrude outwardly therefrom beyond the worksurface;

a plurality of individual storage elements adapted to retain objects therein, and shaped to drop into one of said open frames and be removeably supported from the closed perimeter thereof in a hanging fashion; said storage elements being removably mounted in said open framework in a vertically spaced apart relationship; both sides of said open framework being open to laterally access each of said storage elements from either side of said drawer; said storage elements each being shaped to receive and remove objects therefrom with a generally vertical motion when said drawer is in the open position, whereby convenient storage is provided within arm's length of the worksurface without encroaching upon the knee space to provide improved freedom of movement, particularly in task environments.

17. A vertical storage unit for modular furniture, and the like of the type which includes at least one worksurface with a front edge and an open knee space therebelow, said storage unit comprising:

a hollow, vertically extending cabinet shaped to be supported in a generally vertical orientation underneath the worksurface at a location laterally adjacent to one side of the knee space;

a drawer having a rear, opposite sides, and a front with a rigid face panel extending along the length of said front;

means for slidably mounting said drawer in said cabinet for generally horizontal movement in a direction substantially perpendicular to the front edge of the worksurface between a closed position wherein major portions of said drawer sides are disposed inside of said cabinet body, and an open position wherein major portions of said drawer sides are disposed outside of said cabinet body, and protrude outwardly therefrom beyond the worksurface;

a plurality of storage elements mounted in said drawer in a vertically spaced apart relationship; at least one of said drawer sides being disposed nearest the one side of the knee space, and being open to laterally access each of said storage elements from said one drawer side; said storage elements each being shaped to receive and remove objects therefrom with a generally vertical motion when said drawer is in the open position, whereby convenient storage is provided within arm's length of the worksurface without encroaching upon the knee space to provide improved freedom of movement, particularly in task environments; and wherein;

said storage elements are each oriented generally horizontally;

said cabinet defines the one side of the knee space;

said drawer includes an open framework shaped to receive said storage elements in a drop-in manner and support the same in a hanging fashion;

said storage elements have a modular shape adapted to be received and supported in a plurality of different positions in said framework to adapt the interior arrangement of said storage unit for a wide variety of users and applications;

said storage elements are abuttingly supported in said framework without fasteners to facilitate removal and replacement of the same;

said drawer sides are both open to laterally access said storage elements from either side of said drawer in the open position;

a plurality of differently styled pulls shaped to facilitate opening and closing said drawer;

means for detachably connecting one of said differently styled pulls to said drawer to personalize the exterior appearance of said vertical storage unit;

said storage elements are vertically spaced apart a predetermined distance sufficient to permit objects to be manually placed into and removed from each of said storage elements with a generally vertical hand motion; and said framework is shaped to receive and support hanging files thereon.

* * * * *

UNITED STATES PATENT AND TRADEMARK OFFICE

CERTIFICATE OF CORRECTION

PATENT NO. : 4,960,307
DATED : 10/02/90
INVENTOR(S) : Randall P. Nelsen

It is certified that error appears in the above-identified patent and that said Letters Patent is hereby corrected as shown below:

Column 1, line 37:

After "units" insert --.--;

Column 2, line 67:

After "with" insert --a--;

Column 3, line 3:

After "FIG. 5" insert --is an--;

Column 3, line 4:

After "the" insert --vertical--;

Column 3, line 6:

After "the" insert --vertical--;

Column 3, line 18:

After "in a" insert --fully--;

Column 3, line 19:

After "is a" insert --top--;

Column 3, line 23:

"full" should be --fully--;

UNITED STATES PATENT AND TRADEMARK OFFICE

CERTIFICATE OF CORRECTION

PATENT NO. : 4,960,307

DATED : 10/02/90

INVENTOR(S) : Randall P. Nelsen

It is certified that error appears in the above-identified patent and that said Letters Patent is hereby corrected as shown below:

Column 3, line 21:

After "in the" insert --fully open--;

Column 3, line 23:

After "unit and" insert --modular--;

Column 3, line 61:

"stacked o" should be --stacked or--;

Column 4, line 19:

"worksurfaces" should be --worksurface 19--;

and "Wide Variety" should be --wide variety--;

Column 5, line 9:

"fore-to TM aft" should be --fore-to-aft--;

Column 6, line 43:

"ar" should be --are--;

Column 6, line 46:

After "108" insert --of--;

Column 8, claim 1, line 47:

"receiver" should be --receive--;

UNITED STATES PATENT AND TRADEMARK OFFICE

CERTIFICATE OF CORRECTION

PATENT NO. : 4,960,307

DATED : 10/02/90

INVENTOR(S) : Randall P. Nelsen

It is certified that error appears in the above-identified patent and that said Letters Patent is hereby corrected as shown below:

* Column 10, claim 16, line 2:

"paid" should be --said--.

Signed and Sealed this

Seventh Day of April, 1992

*Attest:*

*Attesting Officer*

HARRY F. MANBECK, JR.

*Commissioner of Patents and Trademarks*